United States Patent [19]

Goudie

[11] Patent Number: 4,471,548

[45] Date of Patent: Sep. 18, 1984

[54] DISPLAY FRAMES

[75] Inventor: John Goudie, Temple Hills, Md.

[73] Assignee: John Goudie Associates, Inc., Brandywine, Md.

[21] Appl. No.: 311,771

[22] Filed: Oct. 15, 1981

[51] Int. Cl.[3] ..... E04H 12/18; G09F 15/00

[52] U.S. Cl. ..... 40/610; 52/109; 52/646; 52/DIG. 4; 52/38

[58] Field of Search ..... 135/106, 110, 111, 109; 52/80, 81, 63, DIG. 4, 109, 646, 697, 38; 40/610, 606

[56] References Cited

U.S. PATENT DOCUMENTS

| | | | |
|---|---|---|---|
| 3,053,351 | 9/1963 | Fulcher | 52/81 |
| 3,121,977 | 2/1964 | Bersudsky | 52/DIG. 4 |
| 3,185,164 | 5/1965 | Pinero | 135/109 |
| 3,304,657 | 2/1967 | Singleton | 52/656 |
| 3,381,923 | 5/1968 | Berry | 248/166 |
| 3,561,518 | 2/1971 | Johnson | 52/63 |
| 3,710,806 | 1/1973 | Kelley | 52/81 |
| 3,740,880 | 6/1973 | Sweet et al. | 40/610 |
| 3,968,808 | 11/1974 | Zeigler | 52/81 |
| 4,026,313 | 5/1977 | Zeigler . | |
| 4,253,284 | 3/1981 | Bliss | 52/109 |
| 4,276,726 | 7/1981 | Derus | 52/646 |
| 4,288,937 | 9/1981 | Virsen | 40/610 |
| 4,290,244 | 9/1981 | Zeigler | 52/109 |
| 4,325,197 | 4/1982 | Achten | 40/155 |
| 4,369,591 | 1/1983 | Vicino | 52/2 |

*Primary Examiner*—John E. Murtagh

*Attorney, Agent, or Firm*—Cushman, Darby & Cushman

[57] ABSTRACT

A collapsible, portable display frame may be erected so that it has either a planar or non-planar face surface. Snap fasteners associated with pivot bodies on the face surface cooperate with stabilizing strips or graphics. Graphics may be easily hung in sheets which cover an entire column of structural units of the display frame, and magnetic strips hold the sheets in alignment along their edges.

13 Claims, 17 Drawing Figures

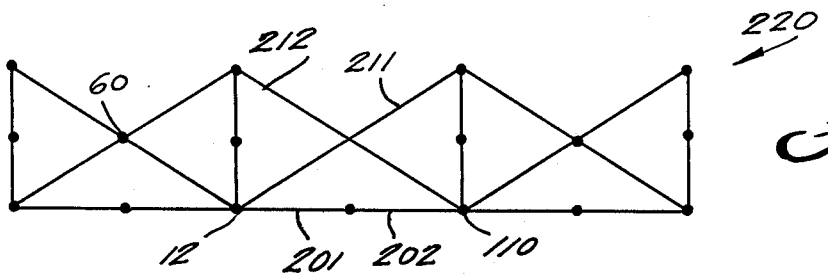
Fig. 5
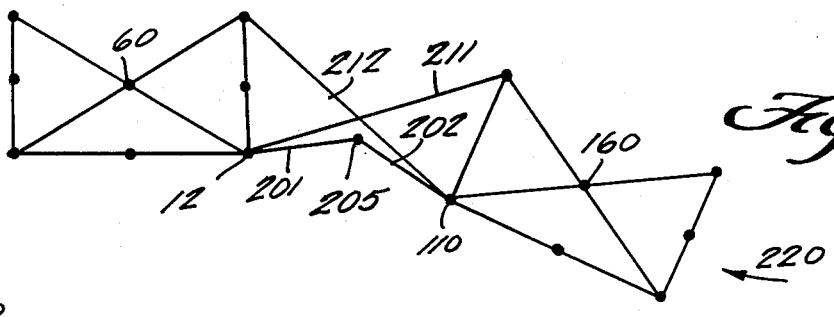
Fig. 6
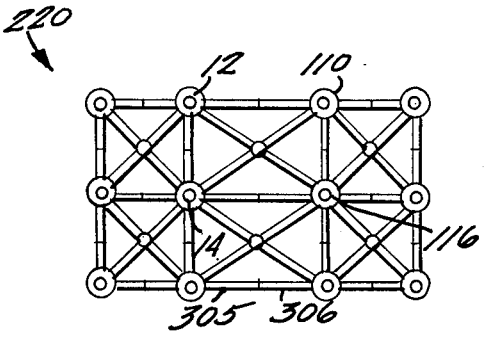
Fig. 7
Fig. 8
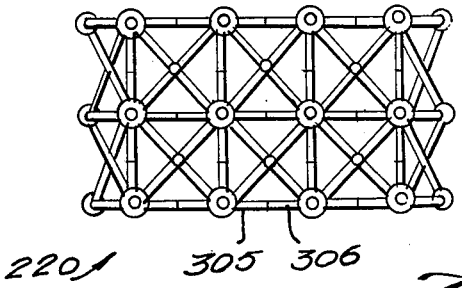
Fig. 9
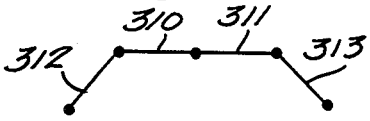
Fig. 10
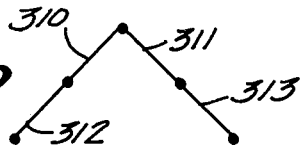
Fig. 11
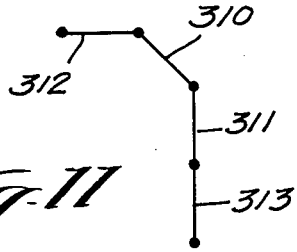

DISPLAY FRAMES

BACKGROUND AND SUMMARY OF THE INVENTION

Recently display frames have been commercially available that are very worthwhile for setting up trade show displays and the like. Such display frames have structural configurations generally as illustrated in U.S. Pat. Nos. 4,276,726, 3,968,808, and 4,026,313. Such structures have achieved wide commercial acceptance because they allow a wide variety of display formats to be utilized therewith while being portable.

While such prior display frames have achieved wide commercial acceptance, there are a few drawbacks associated therewith. Prior display frames inherently have either a substantially planar face surface, or a substantially arcuate face surface. There is no flexibility as to the shape of the face surfaces associated with the structure. Also, there have been problems with stability of prior display frames under some circumstances (such as when supported on thick carpeting or supporting relatively heavy displays), and the display panels attached thereto are conventionally provided so that there is one panel for each section of the display frame, and only one panel is attached at a time. For display frames having nine or twelve sections, the set-up time can be quite long, and the set up procedure fairly difficult.

According to the present invention, a display frame is provided that overcomes the drawbacks associated with prior display frame structures, as discussed above. While certain features of the invention may be utilized in other structures besides display frames, a primary purpose of the invention is to provide a display frame for use at trade shows and the like that is quickly and easily completely assembled, is sturdy, and can be utilized in more than one configuration.

According to the present invention, a display frame is provided which includes at least three structural sections arranged in a row, which are movable from a collapsible to an erect configuration. The configuration of the display structure is such that by setting the relative orientation of parts when in the collapsed configuration it can be moved to an erect configuration having either an essentially planar face surface, or a non-planar face surface. This allows a great deal of flexibility depending upon the configuration of the display booth, the surface on which the device is to be supported, the display graphics utilized, etc. Additionally, the display frame according to the present invention is constructed so that support elements may be readily and simply associated therewith to positively and sturdily support it in its erect configuration (whether with a planar or non-planar face surface).

According to another aspect of the present invention, display graphics are provided for the display frame which take much less time to set up than previous arrangements. The display graphics are provided in the form of elongated sheets, which have a length greater than the length of a single section of the display frame. The structures for fastening the graphics sheet to the display frame allow the graphics to be added quickly and easily, yet proper alignment between the various sheets of the graphics is easily achieved.

While the present invention is primarily related to display frames for trade shows and the like, certain aspects of the invention have applicability to other collapsible structures and display arrangements.

BRIEF DESCRIPTION OF THE DRAWINGS

FIG. 5 is a top plan view of the display frame of FIG. 3 showing the display frame having a planar face surface configuration;

FIG. 6 is a top plan view of the structure of FIGS. 3 and 5 assuming a non-planar face surface configuration;

FIG. 7 is a front (looking in on the face) view of the structure of FIG. 5 when in the collapsed condition;

FIG. 8 is a front view of the structure of FIG. 6 when in the collapsed condition;

FIGS. 9 through 11 are top schematic views of various configurations the face surface of a four-row display frame could take;

DETAILED DESCRIPTION OF THE DRAWINGS

Figure 1:
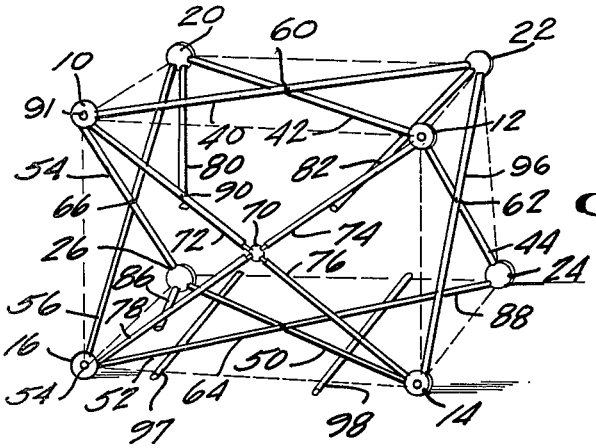
FIG. 1 is a perspective view of a single structural section which is a basic building component for the construction of the display frame according to the present invention, the section being illustrated in an erect configuration.
Figure 2:
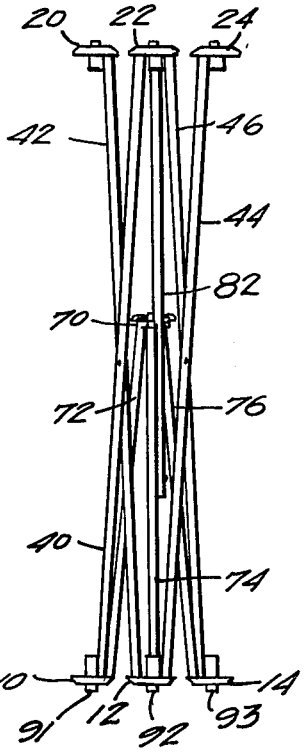
FIG. 2 is a top view of the section of FIG. 1 but in the collapsed configuration.

FIGS. 1 and 2 illustrate an exemplary collapsible articulated structural section according to the present invention, which is utilized as a basic building component of a display frame according to the present invention. The basic structural section as illustrated in FIGS. 1 and 2 is shown and described in more detail in U.S. Pat. No. 4,276,726, the disclosure of which is hereby incorporated by reference herein.

A structural section illustrated in FIG. 1 includes a first plurality of pivot means including pivot means body members 10, 12, 14, and 16, and a second plurality of pivot means including pivot body members 20, 22, 24 and 26. The structural section further comprises a plurality of pivotally interconnected side links for connecting the first plurality of pivot means with the second plurality of pivot means. These links comprise members 40, 42, 44, 46, 50, 52, 54, and 56. The pivotal connections include pivot pins 60, 62, 64, and 66. The ends of the side links (e.g., 40, 42) are connected to the first and second pluralities of pivot means (e.g., 10, 12; 20, 22), preferably in the manner illustrated in U.S. Pat. No. 4,276,726.

The structural section illustrated in FIG. 1 further includes a face pivot means. The face pivot means can comprise a structure such as that illustrated in U.S. Pat. No. 4,276,726, but preferably comprises a ring 70. Pivotally connected to the ring 70 are a plurality of face links 72, 74, 76, and 78, each pivotally connected at one end thereof to the ring 70, and at the other end thereof to one of the first plurality of pivot means (e.g., link 74 to pivot body 12). One or more locking links are also provided. For instance for the embodiment illustrated in FIG. 1, three locking links 80, 82, and 86 are provided. Each locking link is pivotally connected at one end thereof to one of the second plurality of pivot means (e.g., link 80 to pivot body 20), and is pivotally connected (as by a pivot pin 90) at the other end thereof to one of the plurality of face links intermediate its ends (e.g., locking link 80 connected by pivot pin 90 to face link 72).

What has heretofore been described is conventional.

Figure 12:
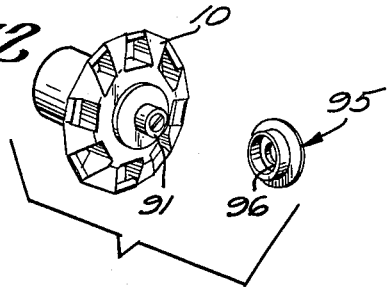
FIG. 12 is a perspective exploded view of snap fastening components utilizable with the first pivot means of the display frame of FIGS. 1 and 3.

The structural section of FIGS. 1 and 2 also comprises, according to the present invention, a male snap fastener extending from at least some of (and preferably all) the first pivot means. For instance, a conventional male snap fastener 91 extends from pivot body 10, snap fastener 92 extends from pivot body 12, snap fastener 93 extends from pivot body 14, and snap fastener 94 extends from pivot body 16. In FIG. 12, the pivot body 10 with male snap fastener 91 extending therefrom is shown in more detail. A cap means 95 with a female snap fastener 96 may be provided cooperating with the male fastener 91 (and/or every other male fastener).

Figure 13:
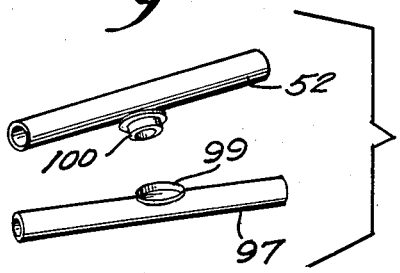
FIG. 13 is a detail perspective exploded view showing one type of stabilizing component utilizable with the display frame of FIG. 1.

According to the present invention, various stabilizing structures are also provided, particularly for supporting the apparatus when on carpeting, or mounting heavy components. One form the stabilizing structure can take are the bottom support rods 97, 98, illustrated in FIGS. 1 and 13. The rods 97, 98 are preferably made of aluminum tubing (like the rest of the structure), but may be of different construction, and preferably have a female snap fastener disposed at each of two spaced points along the length thereof. See female snap fastener 99 in FIG. 13. Each female snap fastener 99 is associated with a male snap fastener disposed at a cooperating point on one of the links 50, 52 when the structure is in the erect configuration. For instance, see male fastener 100 associated with link 52 as illustrated in FIG. 13. By snapping the bottom support rods 97, 98 in place on the fasteners on the bottom of links 50, 52, a more stable structure is provided.

Figure 14:
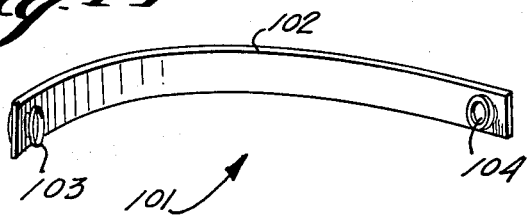
FIG. 14 is a perspective view of a stabilizing strip utilizable with the structure of FIG. 1.
Figure 15:
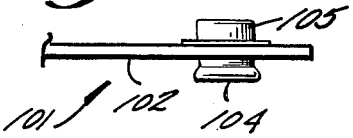
FIG. 15 is a detailed side view of one end of the structure of FIG. 14.

Another form of stabilizing means, which also has other uses, is illustrated generally by reference numeral 101 in FIGS. 14 and 15. This structure includes a strip of rigid material having snap fasteners disposed at spaced portions thereof. As illustrated in the drawings, preferably the strip of rigid material is flexible since compressive forces normally will not be exerted on the strip. For instance as illustrated in FIG. 14, the rigid material comprises a flexible strip 102 of nylon. Female snap fasteners 103, 104 are formed at spaced portions therealong (preferably at either end thereof), the female snap fasteners 103, 104 cooperating with the male snap fasteners (e.g., fastener 91) on the first pivot means (e.g., first pivot body 10), and the female snap fasteners 103, 104 are spaced apart a distance corresponding to the spacing between adjacent male snap fasteners (e.g., 91, 92) when the structure is in the erect configuration. In order to have more than one strip 101 extending from a particular pivot means, a male snap fastener 105 (see FIG. 15) may extend from the opposite face of the strip 102 in line with the female fastener 104. A female snap fastener of another strip 101 may then be snapped into engagement with the male fastener 105, and the other end thereof to another male fastener (as on a first pivot means).

A key feature of the display assembly according to the present invention—which feature allows for flexibility in the configuration of the face surface of the display frame—will now be described with respect to FIGS. 3 through 11.

Figure 3:
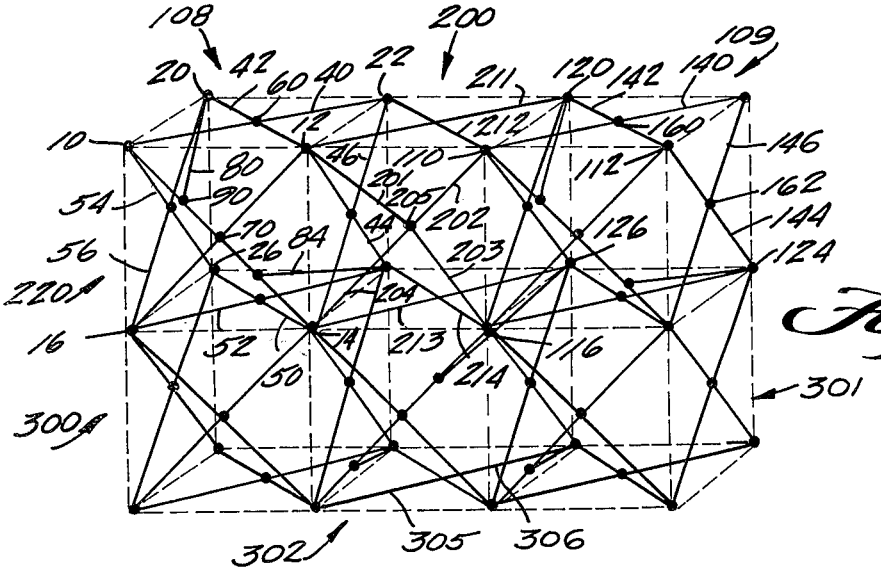
FIG. 3 is a perspective diagrammatic view of an exemplary display frame according to the present invention constructed utilizing sections such shown in FIG. 1 as the basic components thereof.

FIG. 3 shows structures substantially the same as that illustrated in FIG. 1 only disposed in three rows and two columns to provide the display assembly. The first structural section in FIG. 3 is indicated generally by reference numeral 108 and has the same reference numerals associated therewith as the structure illustrated in FIG. 1. A second structural unit is illustrated generally by reference numeral 109, this unit having the component parts thereof labelled by the same reference numerals as the first unit 108 only preceded by the numeral "1". A third unit is indicated generally by the reference numeral 200. This third unit is disposed between the units 108, 109 and has side links 44, 46, 144, 146 and first and second pivot means 12, 110; 22, 120 associated therewith. This unit also comprises a plurality of face links 201 through 204 and a face pivot means 205, and also comprises first and second pairs of side links 210, 211; 212, 213, respectively which cross to define a plane substantially perpendicular to the plane of the first surface of the unit 200 (i.e., a plane containing the face links 201 through 204), and which side links are not in common with the units 108, 109. The characterizing feature of this third unit is that the links 211, 212 and the links 213, 214 thereof are unconnected to each other, rather than being pivoted to each other as all of the side pairs of links associated with the first and second units 108, 109. One or more locking links also are preferably associated with the third unit 200.

With a structure constructed as indicated above, the display assembly—shown generally by reference numeral 220 in FIGS. 3, 5, and 6—may assume more than one configuration. For instance, it can assume the configuration illustrated in FIGS. 3 and 5 wherein the face thereof is substantially planar; or, it may be erected in the configuration illustrated in FIG. 6 wherein the face surface is non-planar. Note that when assembled in the configuration illustrated in FIG. 6, the lengths of the crossed side links 211, 212 do not change (since they are of fixed length), however, the linear distance between the pivot means 12, 110 is reduced compared to the erected configuration of FIG. 5.

FIGS. 7 and 8 illustrate the relative configurations of FIGS. 5 and 6, respectively, but in the collapsed configuration. As illustrated in FIG. 7, if the components of the structure are moved so that the first pivot means 110, 12 and 14, 116 thereof are relatively close together, when the assembly is opened in the normal manner, the erect configuration it assumes is that of FIG. 5. However, if the assembly is in the collapsed condition and the first pivot means 12, 110 and 14, 116 are moved closer together, as illustrated in FIG. 8, the structure when opened in the normal manner assumes the configuration illustrated in FIG. 6.

FIG. 3 also illustrates fourth, fifth, and sixth units indicated generally by the reference numerals 300, 301, and 302, respectively, wherein the unit 300 is identical to unit 108 and has first and second pivot means 14, 16, 24, 26 and side links 50, 52 in common. The fifth unit 301 is identical to the unit 109 and has pivot means 114, 116, 124, and 126 in common, as well as side links 166, 168. The sixth unit 302 is identical to unit 200 also having common first and second pivot means and cross-links 213, 214 therewith. The bottom cross-links 305, 306 of the sixth unit 302 also are unconnected to each other.

Figure 4:
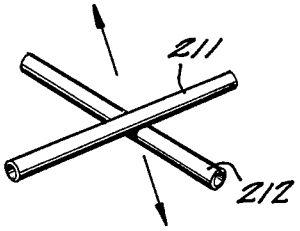
FIG. 4 is a schematic detail view showing unconnected side links utilized in certain sections of the structure according to the present invention.

Display frames according to the present invention can take a wide variety of other forms. For instance when units are disposed so that there are four in a row, by varying which of the units have crossed side links that are unconnected, the configuration of the frame can be changed substantially. For instance in the schematic illustrated in FIG. 9 (only the face surfaces being illustrated in FIGS. 9 through 11), the center sections 310, 311 have all the side links thereof pivotally connected, while all the top and bottom side links of the end units 312, 313 are unconnected (as illustrated in FIG. 4). In the FIG. 10 configuration, the end units 312, 313 have all the side links thereof pivotally connected, while the center units 310, 311 have unconnected top and bottom side links. In the configuration illustrated in FIG. 11, the units 311, 312, and 313 have all the side links thereof pivotally connected, while the section 310 has the top and bottom side links thereof unconnected. Of course it will be seen that a wide variety of other configuration are possible, depending upon the number of units assembled into a frame row, the relative sizes of components of the units, etc.

Figure 16:
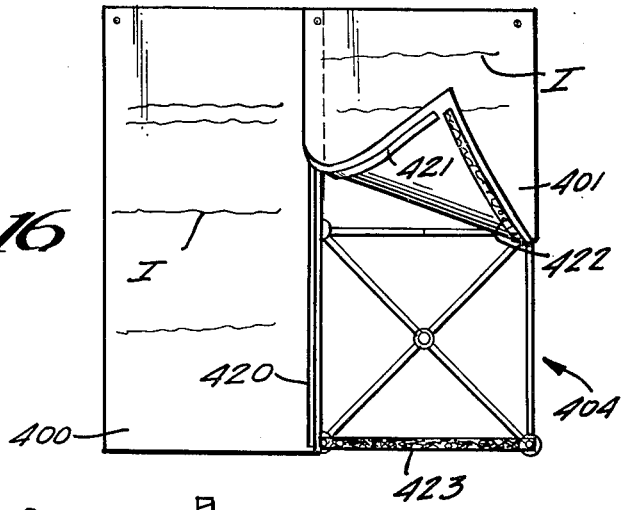
FIG. 16 is a front view of an exemplary display frame with display graphics according to the present invention disposed thereon, with one corner of one display sheet lifted up to illustrate underlying components.
Figure 17:
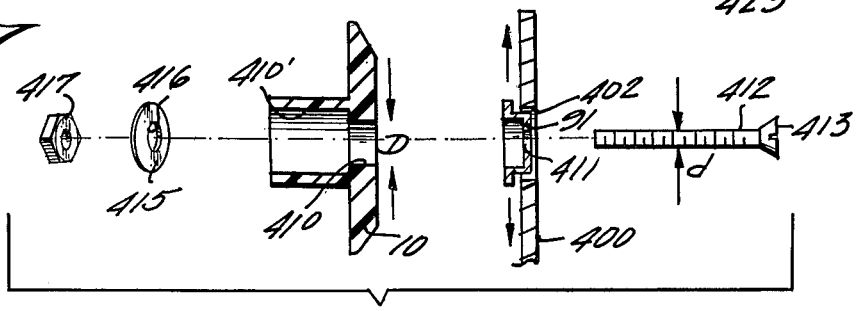
FIG. 17 is a side view, partly in cross-section and partly in elevation, of an exemplary mechanism for allowing adjustment of a male fastener for hanging display sheets vis-a-vis a first pivot means.

Features according to the present invention which allow for the quick assembly of graphics on the display frames are best illustrated with respect to FIGS. 16 and 17. The graphics for the display frame are provided in the form of sheets 400, 401 having indicia I formed on one face thereof. The sheets have holes (see hole 402 in FIG. 17) at one edge thereof, which edge will serve as the "top" of the sheets 400, 401. The holes (e.g., 402) are spaced apart a distance corresponding to the spacing between first pivot means of the underlying display frame (e.g., 220), with the holes dimensioned so that male fasteners, such as the male fastener 91 illustrated in FIG. 17, will pass through the holes. Cap means, such as the cap means 95 illustrated in FIG. 12, snap into engagement with the male fasteners and hold the sheets 400, 401 in place with respect to the male fasteners.

The length and width of the sheets 400, 401 are great enough to cover at least an entire unit face (such as the face of the unit illustrated in FIG. 1), and preferably the length is long enough so that a sheet 400, 401 will cover all of the units in a given column of the display structure. For instance as illustrated in FIG. 16, the display unit, indicated generally by reference numeral 404, has two rows and two columns of units, each sheet 400, 401 being slightly wider than the width of one unit, and being as long as or slightly longer the length of the two units in each column.

In order to provide for proper alignment of the sheets 400, 401, the male fastener that passes through the openings 402 (associated with a top first pivot meaans of the display frame 404) are constructed so that the position of the fastener vis-a-vis the first pivot means is adjustable. For instance with respect to FIG. 17, the male fastener 91 is adjustable in position with respect to the first pivot means body 10. This is preferably accomplished by providing a through-extending central passageway 410 in body 10, the passageway having a diameter D at the face of the body 10. The male fastener 91 has a central bore 411 therethrough. A bolt having a threaded shank 412 of diameter d (which is substantially less than D) has a head 413 adapted to abut the fastener 91 as the shank of the bolt 412 passes through the opening 411. Preferably the opening 411 is only slightly larger than the bolt shank 412, and smaller than the head 413, and the head 413 may be conical as illustrated in FIG. 17.

The length of the bolt shank 412 is such that when the head 413 abuts the fastener 91 the other end of the shank 412 passes out the other side of the body 10. Nut means are provided for operatively engaging the bolt shank and pivot means body to tightly hold the fastener 91 in place with respect to the body 10 in any relative position to which it is moved with respect to the body 10 when the bolt head 413 engages the fastener 91. For instance, the nut means may comprise a washer 415 having a larger diameter than the diameter of the passageway 410 (and than the flared-out end of the passageway 410—illustrated by reference numeral 410'—in the exemplary embodiment illustrated in FIG. 17), with a central bore 416 large enough to receive bolt shank 412, and a nut 417 which threadedly receives the shank 412.

The graphic means according to the present invention also comprises means for holding the sheets 400, 401 in place once they are properly aligned at the top thereof, along substantially the entire length thereof. Such means preferably comprises thin magnetic strips of material 420, 421 as illustrated in FIG. 16. The magnetic strips are cut from thin sheets of magnetic material such as commercially available from Magnetic Inc. and sold under the trade name "Ultramag". The strips 420, 421 may be held in place by adhesive. Strip 420 is disposed along the edge of sheet 400 which overlaps the sheet 401, and extends in a direction perpendicular to the imaginary line between the openings 402 along the top edge of the sheet 400. The opposite polarity of a magnetic strip is faced outwardly to provide the strip 401, and that is placed adjacent the edge of the sheet 401 closest to the sheet 400, extending in the same direction as the strip 420. Normally, the sheets 400, 401 will be rolled up, and as they are rolled downwardly the magnetic strips 420, 421 will be brought into engagement.

In order to hold the bottoms of the sheets 400, 401 in place, if desired some sort of holding means may be provided along the bottoms of the sheets, and the bottom of the display frame 404. In the exemplary embodiment illustrated in FIG. 16, a Velcro strip 422 ("Velcro" being a trade name for hook and pile fasteners) is provided along the bottom of the back of sheet 401, and a cooperating Velcro strip 423 is provided along the bottom of the display frame 404. Preferably the strip 423 is a strip like that illustrated in FIG. 14, only instead of being smooth it has Velcro attached to one face thereof. It is snapped into engagement with male snap fasteners extending from the bottom first pivot means of the frame 404.

The graphic display arrangement as illustrated in FIGS. 16 and 17, as well as the support structures 97, 101, etc., need not be utilized only with the particular type of portable display frame illustrated in FIGS. 1 through 8. For instance, such mechanisms and techniques are equally well utilizable with display frames constructed substantially along the lines disclosed in U.S. Pat. Nos. 3,968,808 and 4,026,313. The same terminology applicable to the type of structure illustrated in FIG. 1 is application to such structures, only—of course—there are substantial differences in the type, connection, and number of components. For instance, no locking links are provided in such other structures, and two sets of face links are provided, each set of face links being connected at one end thereof to one of either said first or said second plurality of pivot means, and being connected at the other end thereof to a "face" pivot means; and additionally each pair of face links are pivotally connected together.

While the terms "male" and "female" fasteners have been used in the specification and claims for convenience in describing the preferred embodiment, it should be understood that the components on which male and female fasteners are provided may be switched (e.g., female fasteners on the first pivot means such as first pivot means 10, and male fasteners on the flexible strips 101), and the claims should be interpreted to cover such modifications.

While the sheets 400, 401 have been illustrated with only one set of openings at the top thereof, it will be understood that a plurality of openings can be provided at the top thereof to accommodate different relative spacings between first pivot means of the display frame with which it might be utilized, and in order to allow use of the same graphics with a display frame whether in the planar face surface, or non-planar face surface, configuration.

Exemplary apparatus according to the present invention having been described, an exemplary manner of utilization thereof will now be set forth.

Utilizing the structure of FIGS. 3 and 5 through 8, it is desirable to erect the display frame so that it has a planar face surface. The first pivot means 12, 110; 14, 116; etc., of the display frame 220 are moved to the relative positions illustrated in FIG. 7. Then one merely grasps a hold of various side links of the structure 220 and pulls outwardly, the structure moving to the erect configuration illustrated in FIGS. 3 and 5. To collapse the structure, it is merely necessary to push down upon the side links forming the top of the structure. If instead it is desirable to erect the structure in a configuration wherein the face is non-planar, the first pivot means are moved to the relative positions illustrated in FIG. 8, and then the same erecting technique is utilized, the final erected configuration being illustrated in FIG. 6.

Once the structure 220 is erected, in order to provide stability the rods 97, 98 may be snapped into engagement with various of the bottom side links of the structure 220, and one or more strips 101 can be snapped between various male fasteners associated with the first pivot means of the structure 220. Additionally, a Velcro strip 423 is snapped along the entire bottom of the unit.

In order to dispose the graphics on the display frame, such as the display frame 404 illustrated in FIG. 16, the openings 402 in the first sheet 400 are placed in registry with the male fasteners (e.g., 91) at the top of the assembly 404. The nuts 417 are loosened to ensure that the sheet 400 hangs straight, and then tightened down to hold the fasteners (e.g., 91) in place once the sheet 400 does hang straight. Then the openings 402 of the second sheet 401 are disposed over fasteners at the top of the assembly 404, including adjacent edges of the sheets 400, 401 being overlapped. Again suitable adjustments are made utilizing the nuts 417, etc., and when alignment is appropriate the sheet 401 is unrolled so that the strip 421 thereof is aligned with (and is attracted by) the strip 420. The bottom is fastened with the Velcro strips 422, 423.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent assemblies and structures.

What is claimed is:

1. A collapsible, articulated structural section which is movable between a stable erect configuration and a collapsed configuration, said structure comprising:

a first plurality of pivot means disposed to be substantially in a first plane in said erect configuration and to be substantially adjacent each other in said collapsed configuration; a second plurality of pivot means disposed to be substantially in a second plane in said erect configuration and to be substantially adjacent each other in said collapsed configuration; a plurality of pivotally interconnected side links for connecting said first plurality of pivot means with said second plurality of pivot means, each of said links being connected with one of said first plurality of pivot means and one of said second plurality of pivot means; a face pivot means; and a plurality of face links, each of said face links connected with said face pivot means and with one of said first pivot means;

a male snap fastener mounted on at least a plurality of said first plurality of pivot means and extending outwardly away from said second plurality of pivot means; and a strip of rigid material, said strip having female fastener means disposed at spaced locations therealong, and said female fastener means being spaced from each other substantially the same distance as the distance between said first plurality of pivot means with male fasteners when said structure is in said erect configuration.

2. A structural section as recited in claim 1 wherein said strip is flexible, and wherein at one portion thereof said flexible strip has a male snap fastener extending outwardly away from the opposite face thereof as, and in line with, said female fastener associated therewith.

3. A structural section as recited in claim 1 wherein said male fasteners are disposed on adjacent first pivot means; and in combination with: a sheet of material having indicia on one face thereof and having a width and length substantially great enough to cover the face surface of said section, said sheet having at one end thereof a pair of spaced openings, each opening being dimensioned to receive a male fastener of said first pivot means therein; and a cap means with a female fastener for operatively engaging each male fastener and holding said sheet in operative association with said structure, each said cap means having a head portion substantially larger than said sheet openings.

4. A combination as recited in claim 1 wherein one pair of side links are bottom side links, each of said bottom side links having at least one male fastener extending downwardly therefrom; and further comprising a rod having a pair of female fasteners spaced along the length thereof a distance corresponding to the spacing between said male fasteners and said bottom side links when said structural section is in an erect configuration.

5. A collapsible, articulated structural section which is movable between a stable erect configuration and a collapsed configuration, said structure comprising:

a first plurality of pivot means disposed to be substantially in a first plane in said erect configuration and to be substantially adjacent each other in said collapsed configuration; a second plurality of pivot means disposed to be substantially in a second plane in said erect configuration and to be substantially adjacent each other in said collapsed configuration; a plurality of pivotally interconnected side links for connecting said first plurality of pivot means with said second plurality of pivot means, each of said links being connected with one of said first plurality of pivot means and one of said second plurality of pivot means; a face pivot means; and a plurality of face links, each of said face links connected with said face pivot means and with one of said first pivot means;

a male snap fastener mounted on at least a plurality of said first plurality of pivot means and extending outwardly away from said second plurality of pivot means, including male fasteners disposed on adjacent first pivot means; and a sheet of material having indicia on one face thereof and having a width and length substantially great enough to cover the face surface of said section, said sheet having at one end thereof a pair of spaced openings, each opening being dimensioned to receive a male fastener of said first pivot means therein; and a cap means with a female fastener for operatively engaging each male fastener and holding said sheet in operative association with said structure, each said cap means having a head portion substantially larger than said sheet openings.

6. A combination as recited in claim 5 wherein said structural section comprises a first structural section, and in further combination with a second structural section substantially identicial with said first structural section, and having a pair of side links, first pivot means, and second pivot means in common; and male fasteners being associated with adjacent first pivot means of said first and second structural sections that are in a row; and wherein said sheet of material having indicia thereon is a first flexible sheet, and further comprising a second flexible sheet of material substantially the same as said first sheet and having indicia thereon; and thin flexible strips of magnetic material disposed on the indicia-containing face of said first sheet along the edge thereof and in a line substantially perpendicular to a line between said fastener-receiving openings therein, and the opposite face of said second sheet along one edge thereof and in a line substantially perpendicular to a line between said fastener-receiving openings therein, said magnetic strips having an attractive force between them and holding said sheets in alignment, with overlapping edges, when said sheet openings are received by said fasteners.

7. A combination as recited in claim 6 further comprising at least one other of said structural sections extending away from each of said first and second sections in a direction perpendicular to a line extending between said face pivot means of said first and second sections adjacent structural sections having side links and first and second pivot means in common with said first and second sections; and wherein each of said indicia-containing sheets has a length sufficient to substantially cover the entire face surfaces of said first and second sections, respectively, and said at least one other section extending from each.

8. A combination as recited in claim 5 further comprising a third structural section substantially identical to said first and second structural sections and having pivot means and side links in common therewith; and wherein the side links at both the top and the bottom of one of said structural sections are unconnected.

9. A combination as recited in claims 5 or 6 wherein said first pivot means having said adjacent male fasteners for penetrating said sheet openings each comprises a body with a through-extending central passageway having a diameter D at the face of said body; said male fastener having a central bore therethrough; a bolt having a shank diameter d less than the diameter of said fastener central bore, and having a head with a greater diameter than said fastener central bore, and adapted to engage said fastener when said shank passes through said central bore; and wherein d is significantly less than D so that the bolt shank is very loose in said body central passageway; and wherein said bolt shank is long enough to pass through said fastener central bore and said body central passageway; and nut means for operatively engaging said shank and body to tightly hold said fastener in place with respect to said body at any relative position to which it is moved with respect to said body when said bolt head engages said fastener and said shank passes through said central passageway.

10. A combination as recited in claims 5 or 6 further comprising means for adjusting the position of said adjacent male fasteners with respect to said first pivot means with which they are associated.

11. A collapsible, articulated structural assembly which is movable between a stable erect configuration and a collapsed configuration, said structure when in the erect configuration having a top, and a front face; a first flexible sheet of material having indicia on one face thereof and having a length substantially as great as the height of said assembly; a second flexible sheet of material having indicia on one face thereof and having a height substantially the same as the height of said assembly; means for holding edges of said first and second sheets at the top of said assembly so that said sheets drape to cover the face of said assembly; and thin flexible strips of magnetic material disposed on the indicia-containing face of said first sheet along one edge thereof, and substantially vertically extending when attached to the top of said assembly, and on the opposite face of said second sheet along one edge thereof adjacent said first sheet and parallel to the magnetic strip on said first sheet, said magnetic strips having an attractive force between them and holding said sheets in alignment, with overlapping edges, when said sheets are draped to cover the face of said assembly.

12. An assembly as recited in claim 11 further comprising fastening means disposed adjacent the bottom of said assembly, and cooperating fastening means disposed along the bottom edge face of each sheet overlaying said assembly.

13. A collapsible, articulated structural section which is movable between a stable erect configuration and a collapsed configuration, said structure comprising:

a first plurality of pivot means disposed to be substantially in a first plane in said erect configuration and to be substantially adjacent each other in said collapsed configuration; a second plurality of pivot means disposed to be substantially in a second plane in said erect configuration and to be substantially adjacent each other in said collapsed configuration; a plurality of pivotally interconnected side links for connecting said first plurality of pivot means with said second plurality of pivot means, each of said links being connected with one of said first plurality of pivot means and one of said second plurality of pivot means; a face pivot means; and a plurality of face links, each of said face links connected with said face pivot means and with one of said first pivot means;

a male snap fastener mounted on at least a plurality of said first plurality of pivot means and extending outwardly away from said second plurality of pivot means;

one pair of side links comprising bottom side links, and each of said bottom side links having at least one male fastener extending downwardly therefrom; and a rod having a pair of female fasteners spaced along the length thereof a distance corresponding to the spacing between said male fasteners and said bottom side links when said structural section is in an erect configuration.

* * * * *